US005107731A

United States Patent [19]

Kent

[11] Patent Number: 5,107,731

[45] Date of Patent: Apr. 28, 1992

[54] AUTOMATIC SLICING SYSTEM FOR SLICING AND UNIFORMLY STACKING A COMESTIBLE PRODUCT

[75] Inventor: David P. Kent, Coatesville, Pa.

[73] Assignee: Pennsylvania Slicer and Equipment Company, West Chester, Pa.

[21] Appl. No.: 527,608

[22] Filed: May 23, 1990

[51] Int. Cl.[5] ..... B26D 7/30

[52] U.S. Cl. ..... 83/91; 83/77

[58] Field of Search ..... 83/77, 92, 88, 91

[56] References Cited

U.S. PATENT DOCUMENTS

| | | | |
|---|---|---|---|
| 2,224,557 | 12/1940 | Van Berkel | 83/92 |
| 2,438,937 | 4/1948 | Metzler | 83/92 |
| 3,452,833 | 7/1969 | Wolters . | |
| 3,605,837 | 4/1969 | Lambert et al. . | |
| 3,827,319 | 8/1974 | Flesch | 83/73 |
| 3,906,823 | 9/1975 | Spooner | 83/73 |
| 3,938,602 | 2/1976 | Sly et al. | 177/116 |
| 3,995,517 | 12/1976 | Smith | 83/13 |
| 4,015,494 | 4/1977 | Spooner et al. | 83/76 |
| 4,129,053 | 12/1978 | Kent | 83/69 |
| 4,217,650 | 8/1980 | Kuchler | 364/567 |
| 4,379,416 | 4/1983 | Kuchler | 83/23 |
| 4,405,186 | 9/1983 | Sandberg | 414/21 |
| 4,598,618 | 7/1986 | Kuchler | 83/77 |
| 4,763,738 | 8/1988 | Kuchler | 177/50 |
| 4,794,996 | 1/1989 | Wallace et al. | 177/25.14 |

FOREIGN PATENT DOCUMENTS

| | | | |
|---|---|---|---|
| 3630037 | 3/1988 | Fed. Rep. of Germany | 83/77 |

*Primary Examiner*—Frank T. Yost
*Assistant Examiner*—John M. Husar
*Attorney, Agent, or Firm*—Panitch Schwarze Jacobs & Nadel

[57] ABSTRACT

An automatic slicing system for slicing a comestible product and forming a uniform stack of slices of the sliced product, wherein the sytem is preferably used in small grocery stores and delis. The slicer comprises a rotary slicer blade having an operational cutting edge for slicing a comestible product. A product feed member is positioned on one side of the slicer blade for holding and moving the comestible product into engagement with the slicer blade. The product feed member oscillates the comestible product between a first position wherein the comestible product is on one side of the operational cutting edge not in engagement therewith, and a second position wherein the comestible product is on another side of the operational cutting edge not in engagement therewith, such that as the comestible product moves from the first position the second position a slice of comestible product is removed therefrom. A reciprocating receiving surface is positioned below the slicer blade and is synchronized for movement with the product feed member such that as the product feed member moves between the first and second positions, the receiving surface moves correspondingly therewith to receive each product slice in a uniform stacked manner.

19 Claims, 3 Drawing Sheets

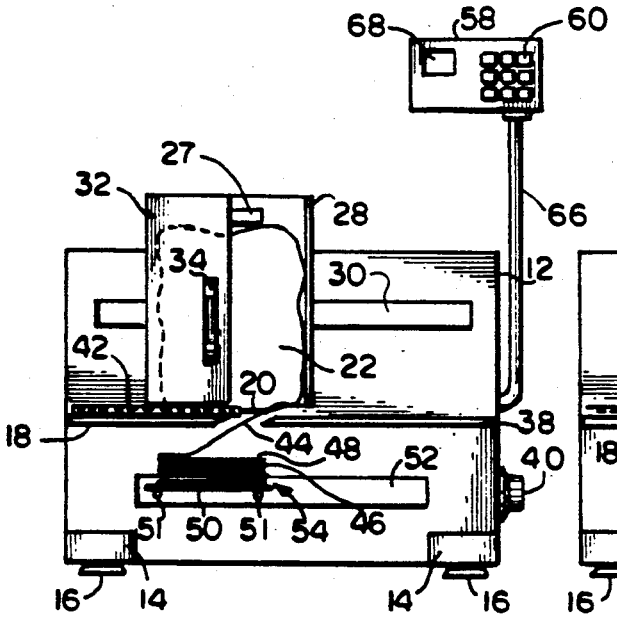
FIG.3
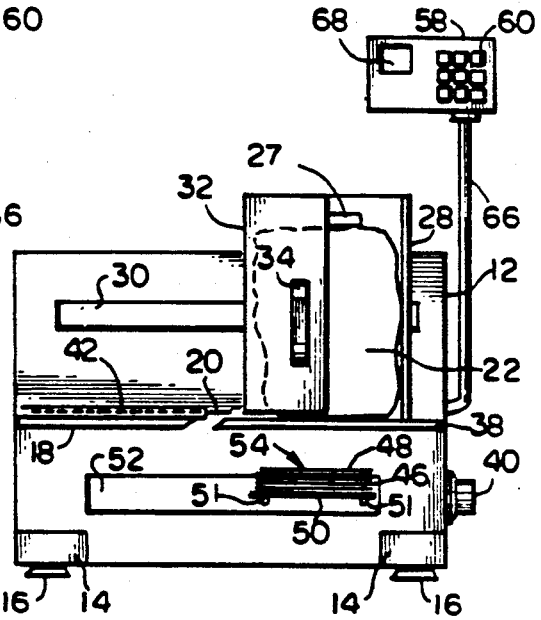
FIG.2
FIG. 1
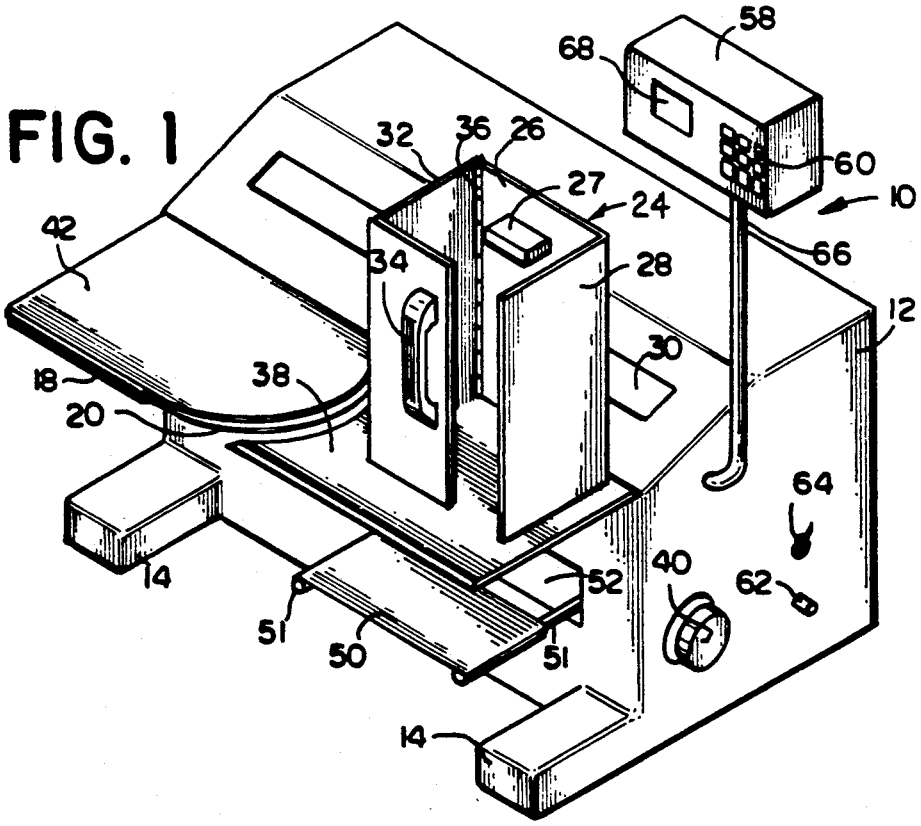

AUTOMATIC SLICING SYSTEM FOR SLICING AND UNIFORMLY STACKING A COMESTIBLE PRODUCT

FIELD OF THE INVENTION

The present invention relates to an automatic slicing system for the slicing of comestible products and, more particularly, to an automatic slicing system for slicing, weighing and uniformly stacking a comestible product.

BACKGROUND OF THE INVENTION

In the retail food industry, specifically, small grocery stores, delicatessens, restaurants and the like, a great deal of bulk luncheon meats and cheese are sold over the counter which are sliced and weighed according to customer order. The employee must by trial and error manually slice the food and then weigh the same. This usually results in many trips back and forth between the slicing means and the weighing scale before the proper amount of food is sliced. In addition, the employee must stay and operate the slicer in order to fulfill the customer's order. Consequently, a great deal of time is lost in performing this function since the employee could be performing other sales services for the customer if an automatic system existed.

In an effort to solve the problem of interrupting the slicing operation to set the already cut slices down on a scale to verify the weight, slicers have been developed which automatically weigh the sliced product as it is sliced. Thereby eliminating the need for the operator to make trips back and forth between the slicing means and the weighing scale to ascertain the proper weight of the product sliced. However, even with this apparently time saving feature, the operator must still stay at the slicer to either manually slice the food or in the case of an automatic slicer the operator must stay to receive and place the sliced product in a uniform stack.

The prior art automatic slicing systems do not include an efficient and economically feasible device for receiving, weighing and uniformly stacking the sliced product. Moreover, such automatic slicing systems do not include a mechanism for easily varying how the sliced product is stacked, for instance, shingled, fluffed or generally vertically aligned.

Consequently, in the comestible product slicing field, there exists a need for an inexpensive automatic slicing system which can slice, count, weigh and uniformly stack a comestible product. Moreover, there exists a need for such an automatic slicing system which is operator safe and will not cause operator fatigue.

The present invention overcomes many of the disadvantages inherent in the above-described automatic or manual slicing systems by providing an automatic slicing system for slicing a comestible product and forming a uniform stack of the sliced product. The automatic slicing system of the present invention also includes means for simultaneously weighing the sliced product. The automatic slicer of the present invention receives a comestible product, automatically slices and stacks the comestible product until the desired weight is achieved, whereupon the slicer stops and an audible signal is sounded to alert the operator of the completed cycle. The present invention further controls the slicing stroke in accordance with the width of the comestible product and the feed rate in accordance with the difficulty of slicing the comestible product to thereby save overall operating time and achieve uniform slice thickness.

Consequently, the automatic slicing system of the present invention is economically efficient, operator safe and reduces operator fatigue. Moreover, use of the present invention results in considerable savings in money as well as time for the over the counter customer ordered cold cut businesses and the like.

SUMMARY OF THE INVENTION

Briefly stated, the present invention comprises an automatic slicing system for slicing a comestible product and forming a uniform stack of slices of the sliced product. The slicer comprises a generally flat movable slicer blade having an operational cutting edge for slicing a comestible product. A product feed member is positioned on one side of the slicer blade for holding and moving the comestible product into engagement with the slicer blade. The product feed member is reciprocally driven to oscillate the comestible product between a first position wherein the comestible product is on one side of the operational cutting edge not in engagement therewith and a second position wherein the comestible product is on another side of the operational cutting edge not in engagement therewith, such that as the comestible product moves from the first position to the second position, a slice of the comestible product is removed therefrom. The product feed member is driven from the first position to the second position at least twice for slicing at least first and second slices of the comestible product. A reciprocating receiving means is positioned on the other side of the slicer blade and is movable between a first and second position and is synchronized for movement with the product feed member, such that as the product feed member moves between the first and second positions, the receiving means moves correspondingly therewith to receive each product slice in a uniform stacked manner.

BRIEF DESCRIPTION OF THE DRAWING

The foregoing summary as well as the following detailed description of the preferred embodiment, is better understood when read in conjunction with the appended drawings. For the purpose of illustrating the invention, there is shown in the drawings, an embodiment which is presently preferred, it being understood, however, that the invention is not limited to the specific methods and instrumentalities disclosed. In the drawings:

FIG. 1 is a perspective view of an automatic slicing system in accordance with the present invention;

FIG. 2 is a front elevational view of the automatic slicing system of FIG. 1 showing a comestible product thereon;

FIG. 3 is a front elevational view of the automatic slicing system of FIG. 1 showing a partially sliced comestible product thereon.

DESCRIPTION OF PREFERRED EMBODIMENT

Figure 4A:
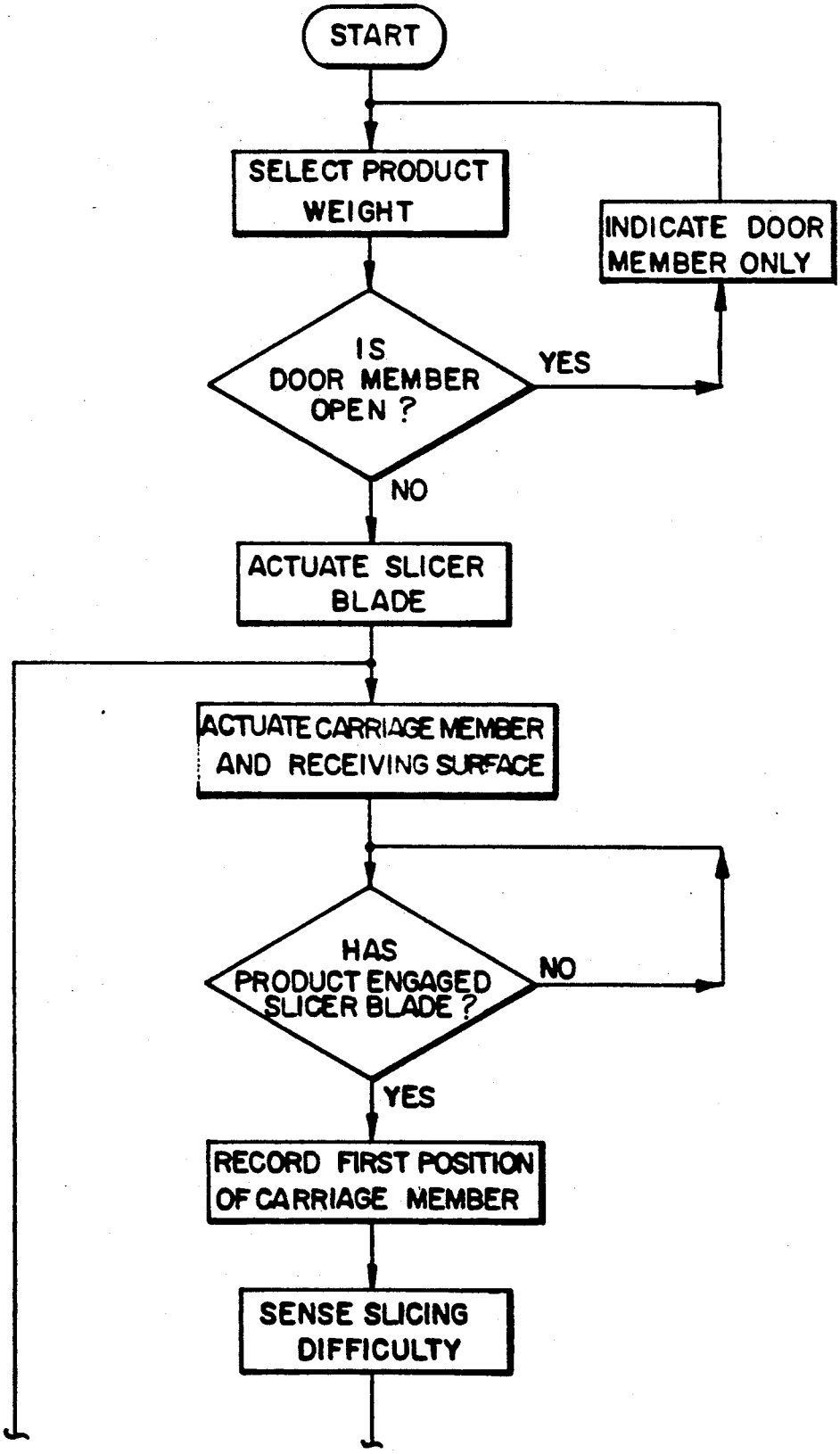
FIGS. 4A and 4B are functional flow chart representations of the preferred method of operation of the microprocessor portion of the present invention.
Figure 4B:
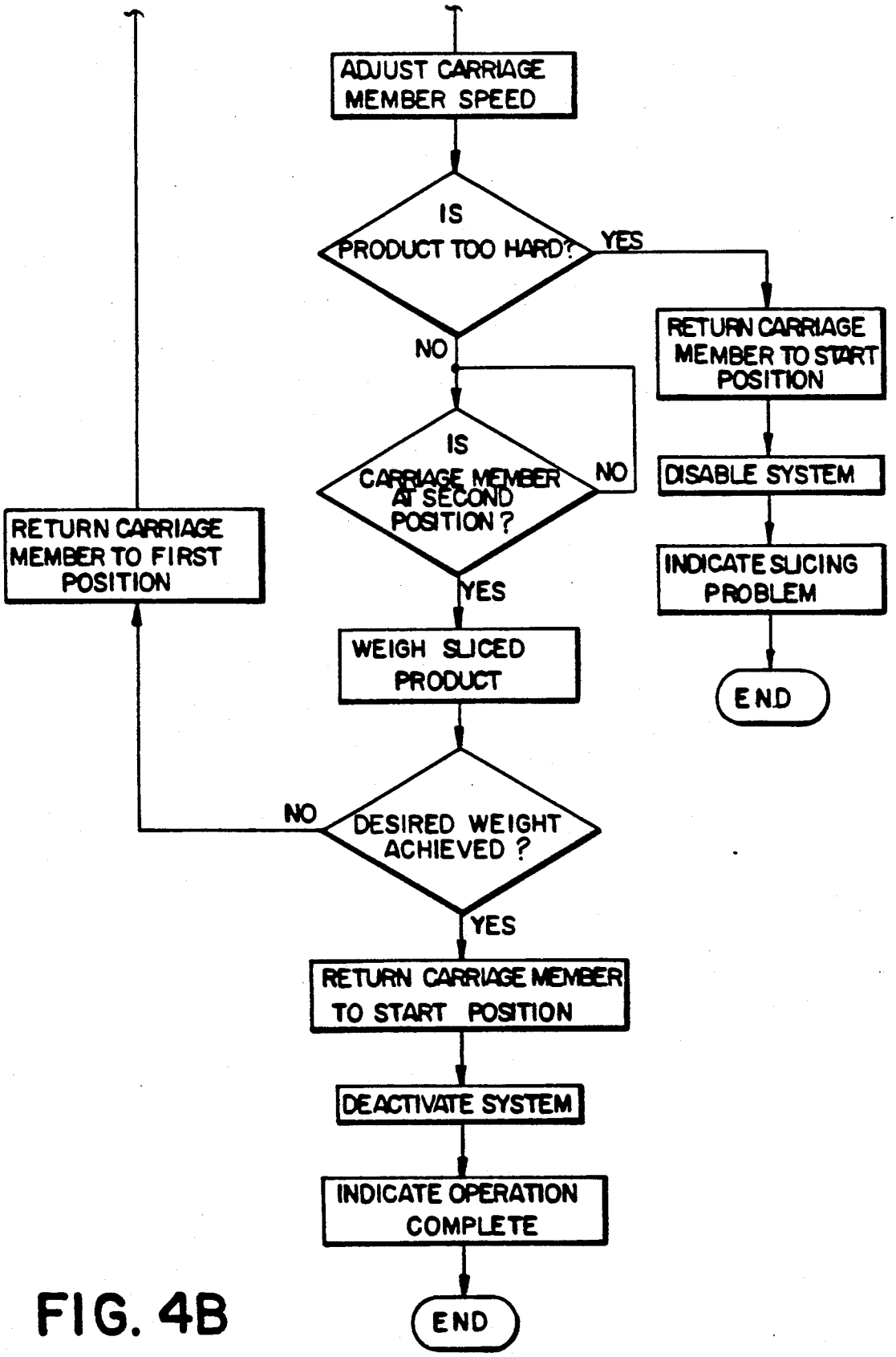

Certain terminology is used in the following description for convenience only and is not limiting. The words "right", "left", "lower" and "upper" designate directions in the drawings to which reference is made. The words "inwardly" and "outwardly" refer to directions toward and away from, respectively, the geometric center of the automatic slicing system and designated parts thereof. The terminology includes the words above specifically mentioned, derivatives thereof and words of similar import.

Referring to the drawings, wherein like numerals indicate like elements throughout, there is shown in FIG. 1 a perspective view of an automatic slicing system, generally designated 10, for slicing a comestible product and forming a uniform stack of slices of the sliced product in accordance with the present invention. The automatic slicing system 10 includes a housing 12 and a base portion 14. The housing 12 receives and supports various elements of the system, as is apparent from the description hereinafter. The base portion 14 includes a set of downwardly depending legs 16, see FIG. 2, for supporting the housing 12 and automatic slicing system 10.

In the present embodiment, it is preferred that the housing 12 be constructed of a lightweight metallic material, such as stainless steel. However, it is understood by those skilled in the art, that other materials could be used to construct the housing 12, such as aluminum or some other metallic alloy of like or similar quality. Preferably, the legs 16 are constructed of a soft dampening type material for firmly positioning the automatic slicing system 10 at its location upon a supporting surface such as a standard counter and for reducing vibration thereof. Specifically, it is preferred that the legs 16 be constructed of a closed-cell rubber, as is understood by those skilled in the art.

For ease of description only, it is understood that the remaining elements of the automatic slicing system 10 are preferably constructed of the same material as the housing 12, unless otherwise indicated.

As shown in FIG. 2, the automatic slicing system 10 includes a generally flat movable slicer blade 18 having an operational cutting edge 20 for slicing a comestible product 22. In the present embodiment, it is preferred that the slicer blade 18 be of the circular type wherein the circumferential edge thereof is sharpened to operate as a cutting edge, as is understood by those skilled in the art. The term operational cutting edge 20 is defined as that portion of the sharpened circumferential edge of the slicer blade 18 which is exposed to the comestible product 22, as described hereinafter.

Preferably, the slicer blade 18 has a diameter of approximately 12½ inches for providing a cutting capacity for comestible products having a width of up to 11 inches, as described in more detail hereinafter. However, it is also understood by those skilled in the art, that the present invention is not limited to any particular size or type of slicer blade and, is equally applicable to a reciprocating slicer blade or the like as opposed to a rotary blade.

In the present embodiment, it is preferred that the slicer blade 18 be driven by an electrical motor (not shown) through suitable gearing, if desired, as is understood by those skilled in the art. Further description of the means for driving or rotating the slicer blade 18 is not necessary or limiting, since it is not pertinent to the present invention and is understood by those skilled in the art.

Referring now to FIGS. 1 and 2, there is shown a product feed member 24 positioned on one side of the slicer blade 18 for holding and moving the comestible product 22 into engagement with the operational cutting edge 20 of the slicer blade 18. In the present embodiment, the product feed member 24 preferably comprises a carriage member 26 for securably receiving the comestible product 22. More particularly, the carriage member 26 preferably includes a generally L-shaped driven member 28, which is fixedly secured to and driven by a transmission or drive means (not shown) positioned within the housing 12. The driven member 28 is preferably fixedly secured to the drive means within the housing 12 by means of linkage or the like (not shown) extending through the slot 30 for allowing the driven member 28 to oscillate therealong.

The specific type of transmission or drive means utilized is not pertinent to the present invention, consequently specific description thereof is neither necessary nor limiting, since such means is within the ambit of the ordinarily skilled artisan.

As shown in FIG. 1, the carriage member 26 further includes a generally L-shaped door member 32 hingedly secured to the driven member 28 for allowing the door member 32 to pivot with respect thereto. The door member 32 is preferably connected to the driven member 28 by a hinge 36. The door member 32 preferably includes a handle 34 for allowing the user to easily grip the door member 32. In the present embodiment, it is preferred that the handle 34 be constructed of a polymeric material, such as polyvinyl chloride. However, it is understood by those skilled in the art, that the handle 34 could be constructed of other materials, such as stainless steel or aluminum, without departing from the spirit and scope of the invention.

In the present embodiment, the comestible product preferably is a cold cut of meat or cheese, as is understood by those skilled in the art. However, it is also understood by those skilled in the art, that other types of comestible items can be sliced by the automatic slicing 10, such as raw or smoked meats or fish, without departing from the spirit and scope of the invention. Consequently, the present invention is not limited to any specific type of comestible product.

In the present embodiment, it is preferred that the comestible product 22 be slidably disposed within the carriage member 26. Consequently, as a slice is cut or removed from the comestible product 22, the comestible product 22 slides downwardly by gravity feed into position for having another slice removed therefrom. In the present embodiment, it is preferred that the carriage member 26 also include means for forcing the comestible product 22 downwardly into engagement with the table 38. Preferably, the means for forcing the comestible product 22 downwardly includes a spring-loaded member 27 slidably disposed on the driven member 28, as shown in FIG. 1. The spring-loaded member 27 could be mechanically actuated in accordance with the desired slice thickness. However, it is understood by those skilled in the art, that the spring-loaded member 27 could be obviated and that the comestible product 22 could slide downwardly with respect to the carriage member 26 simply due to the force of gravity.

To place the comestible product 22 within the carriage member 26, the door member 32 is pivoted away from the driven member 28. The comestible product 22 is then positioned therewithin under the spring-loaded member 27 as shown in FIG. 2. The door member 32 is then pivoted and secured in the closed position using any suitable type fastener (not shown) as is known to those skilled in the art. The carriage member 26 preferably includes a sensor (not shown) for sensing whether the door member 32 is in the closed or open position. The sensor is used to prevent operation of the automatic slicing system 10 unless the door member 32 is in the closed position, as is understood by those skilled in the art.

While in the present embodiment, it is preferred that the carriage member 26 be generally vertically or perpendicularly oriented with respect to the slicer blade 18, it is understood by those skilled in the art that the carriage member 26 could include a tilt mechanism (not shown) for tilting the carriage member 26 and its associated comestible product 22 at an angle with respect to the slicer blade 18. This would provide for the slicing of comestible products which are short in width in order to obtain larger dimensioned finished slices. Such comestible products typically include fish, such as salmon.

In the present embodiment, it is preferred that the table 38 be secured to the housing 12 adjacent the operational cutting edge 20 of the slicer blade 18 such that the table 38 is movable upwardly and downwardly with respect thereto. The vertical position of the table 38 with respect to the cutting edge 20, determines the thickness of the sliced comestible product 22, as is understood by those skilled in the art.

The means for moving the table 38 with respect to the cutting edge 20 is not pertinent to the present invention, and is understood by those skilled in the art. The relative position of the table 38 is preferably manually controlled by a knob 40 and transmission (not shown), as is known to those skilled in the art. However, it is also understood by those skilled in the art, that the relative position of the table 38 could be electronically controlled by way of a positioning motor (not shown) and programmable microprocessor.

As shown in FIGS. 1 and 3, a cover member 42 is positioned over the slicer blade 18 to enhance the overall safety of the automatic slicing system 10. That is, the cover member 42 almost completely surrounds the circumference of the slicer blade 18, except for the operational cutting edge 20 which is exposed to the comestible product 22. Consequently, the automatic slicing system 10 is safe because only the most necessary portion of the cutting edge 20 is exposed and there are no sharp moving parts which are exposed.

Referring now to FIGS. 2 and 3, the product feed member 24 is reciprocally driven to oscillate the comestible product 22 between a first position (see FIG. 2) wherein the comestible product 22 is on the right or one side of the operational cutting edge 20, but not in engagement therewith and a second position (not shown) wherein the comestible product is on the left or another side of the operational cutting edge 20, but not in engagement therewith. As illustrated in FIG. 3, when the comestible product 22 moves from the first position to the second position a single slice 44 of the comestible product 22 is removed therefrom. Preferably, the product feed member 24 is driven from the first position to the second position at least twice for slicing at least first and second slices 46, 48, respectively, of the comestible product 22. Each of the first and second slices 46, 48 has a first or lower surface, a second or upper surface and a circumferential edge, respectively.

As shown in FIGS. 2 and 3, a reciprocating receiving means is positioned below or on the lower or other side of the slicer blade 18. The receiving means is movable between a first and second position and is synchronized for movement with the product feed member 24, such that as the product feed member 24 moves between its first and second positions, the receiving means moves correspondingly therewith in a predetermined relationship to receive each product slice in a uniform stacked manner. The first and second positions of the reciprocating receiving means generally correspond to the first and second positions of the product feed member 24, since the reciprocating receiving means and the product feed member 24 are synchronized. However, it is understood by those skilled in the art that the first and second positions of the reciprocating receiving means and the first and second positions of the product feed member 24, may be synchronized such that they are offset to achieve different types of stacking characteristics, as described in more detail hereinafter.

In the present embodiment, it is preferred that the receiving means be a generally flat receiving surface 50 for receiving each slice of the comestible product 22. As shown in FIG. 1, in the present embodiment, it is preferred that the receiving surface 50 be a tray or table-like member fixedly secured to a pair of generally cylindrical support rods 51 which, in turn, are operatively associated with a transmission or drive means (not shown) within the housing 12, as is understood by those skilled in the art. More particularly, it is preferred that the support rods 51 be interconnected to the drive means through a slot 52 in the housing 12.

As shown in FIGS. 2 and 3, the slot 52 is positioned generally horizontal with respect to the slicer blade 18. However, it is understood by those skilled in the art, that the portion of the slot 52 beneath the slicer blade 18 may be angled approximately 30°. with respect to the slicer blade 18, so that the receiving surface 50 moves downwardly away from the slicer blade 18. This allows for more uniform stacking because the angle of the slice 44 being removed from the slicer blade 18 is approximately 30°.

In the present embodiment, it is preferred that the drive means for the product feed member 24 be mechanically or electrically interconnected to or associated with the drive means for the receiving surface 50 for providing the abovementioned synchronization. For instance, the product feed member 24 and the receiving surface 50 could be each directly connected to a single drive means for providing a direct relationship or synchronization to the reciprocation thereof. In addition, the receiving surface 50 and the product feed member 24 could be connected to a single drive means, but linkage or the like could be employed therebetween to achieve different types of synchronization and, consequently, different stacking patterns on the receiving surface 50, as described in more detail hereinafter. However, as is understood by those skilled in the art, the product feed member 24 and the receiving surface 50 could also each be connected to a different electrical motor which is controlled by a microprocessor to achieve different types of synchronization.

As shown in FIGS. 2 and 3, in the present embodiment, it is preferred that the reciprocating receiving surface 50 receive the sliced comestible product 22 such that the upper surface of the first slice 46 be in direct engagement with the lower surface of the second slice 48 with the circumferential edge of the first slice 46 being generally aligned with the circumferential edge of the second slice 48 to thereby form a uniform stack 54 of the comestible product 22 having a top or second slice 48. This type of generally aligned uniform stack 54 is preferably achieved by synchronizing the product feed member 24 and the receiving surface 50 such that the receiving surface 50 moves 10% faster than the product feed member 24. This prevents the leading edge of each slice from wrinkling because of the angular position of the slice as it leaves the slicer blade 18.

However, it is understood by those skilled in the art, that other types of synchronization can be utilized to stack the sliced product in different formations. For instance, the sliced product could be arranged in a shingled stack by synchronizing the product feed member 24 and the receiving surface 50 such that they are slightly out of phase. For instance, the receiving surface 50 could be moved to the right a small amount (e.g., ⅛ of an inch) at the beginning of each cycle or oscillation to thereby create a shingled stack of sliced product. Additionally, the product feed member 24 and the receiving surface 50 could be synchronized to achieve a fluffed stack of sliced product. To achieve a fluffed stack of sliced product, the receiving surface 50 would oscillate a small distance back and forth beneath the operational cutting edge 20 as the product feed member 24 moves from the first position to the second position. It is understood that the present invention is not limited to any specific type of synchronization to achieve any particular type of stacked, sliced product, since the product feed member 24 and the receiving surface 50 can be synchronized in other manners to achieve different types of stacks.

In the presently preferred embodiment, the receiving means further includes positioning means (not shown) for positioning the receiving surface 50 such that the top slice 48 of the uniform stack 54 is maintained at a first predetermined vertical distance from the operational cutting edge 20 and for allowing the uniform stack 54 of sliced product 22 to receive the next or another slice of the comestible product, as the comestible product 22 oscillates between the first and second positions. Preferably, the first predetermined distance is defined such that the top slice 48 of the uniform stack 54 partially receives and engages the next or another slice 44 of the comestible product 22 thereon before the next slice 44 is completely removed from the comestible product (as shown in FIG. 3), thereby allowing the sliced comestible product to be stacked in a uniform manner. Consequently, the next slice 44 does not freely fall to the uniform stack 54, but is evenly and smoothly deposited on the top slice 48.

Preferably, the positioning means moves the receiving surface 50 downwardly or away from the operational cutting edge 20 by a second predetermined distance such that the current and each succeeding top slice of the uniform stack 54 is maintained at the first predetermined distance from the operational cutting edge 20. Preferably, the second predetermined distance is approximately equal to the thickness of each slice of the comestible product 22. That is, the second predetermined distance is approximately equal to the vertical distance between the upper surface of the table 38 which receives the comestible product 22 to be sliced thereon and the operational cutting edge 20.

The positioning means is preferably comprised of a transmission interconnected between the knob 40 and the receiving surface 50. Such a transmission could comprise mounting the receiving surface 50 on a nut and screw assembly for vertical movement wherein the nut includes external teeth for cooperation with a rack, wherein the position of the rack is controlled by the knob 40.

In the present embodiment, it is preferred that the receiving surface 50 be movable outwardly away from the housing 12 and out from beneath the table 38 for allowing easy access to the uniformly stacked sliced product upon completion of the slicing cycle.

In the present embodiment, it is preferred that the receiving means further include weight sensor means (not shown) for simultaneously sensing the weight of the sliced comestible product thereon and for generating an electrical signal corresponding to the weight. Consequently, the weight of the sliced product is monitored as each slice is removed from the comestible product 22. In the present embodiment, it is preferred that the weight sensor means comprise a load cell or strain gauge positioned on the slot 52 beneath the slicer blade 18, as is understood by those skilled in the art. Since the specific type of weight sensor is not pertinent to the present invention, further description thereof is neither necessary nor limiting.

As shown in FIG. 1, the automatic slicing system 10 includes control means for at least controlling the operation for the product feed member 24 and the position of the receiving surface 50. In the present embodiment, it is preferred that the control means comprise a programmable microprocessor within a control housing or box 58, preferably the microprocessor receives input for a variety of parameters by using a key pad 60 located on the surface of the control box 58. For instance, the operator of the automatic slicing system 10 may wish to enter the desired weight of thecomestible product 22 to be sliced; the cost per pound of the comestible product 22; a desired number of slices instead of weight; the thickness of each slice of the comestible product 22; the type of stack, etc. The microprocessor based control system functions to control the operation of the slicing system 10 to achieve the desired result.

As shown in FIG. 2, in the present embodiment, it is preferred that the control box 58 be positioned on a support tube 66 for carrying electrical and/or communication wires associated with the transmission or drive means and other sensors and for positioning the microprocessor in an area where it is easy for the operator to access and view. The support tube 66 is preferably generally vertically oriented and interconnected to the housing 12.

The microprocessor preferably includes digital display 68 (e.g., liquid crystal or the like) for displaying information to the operator, such as current weight, total cost, etc. Upon the microprocessor receiving the parameter information which the user desires, the user presses the start button (not shown) on the key pad 60 and the automatic slicing system 10 commences operation.

The specific type of microprocessor employed is not pertinent to the present invention. That is, the choice of the microprocessor and its program are within the ambit of the ordinarily skilled artisan and, therefore, further description of the specifics thereof is neither necessary nor limiting.

Preferably, the microprocessor is responsive to electrical signal received from the weight sensor means for stopping movement of the product feed member 24 when the sliced product reaches the selected weight, which was entered into the microprocessor by the operator. In the present embodiment, it is preferred that the automatic slicing system 10 include means (not shown) for sounding an audible signal when the sliced product attains the desired weight for signaling the operator that the slicing operation is complete. As mentioned previously, the microprocessor controls the drive or transmission means to control the relative movement of the product feed member 24 and the receiving surface 50 to vary the type of stack of sliced product. For instance, the product feed member 24 and the receiving surface 50 can be synchronized so as to produce a shingled stack (not shown) of sliced product or a fluffed stack (not shown) of sliced product.

Additionally, the microprocessor can be programmed to obtain consistent slice thickness for even the hardest to cut products by varying the carriage member 26 stroke rate according to the can also be programmed for subjective high speed slicing to correspond to the width of the comestible product 22 by precisely controlling the carriage member 26 stroke distance according to such width. Furthermore, the programmable microprocessor could be interconnected with a printer for printing a label for the sliced product indicating the final weight and price of the sliced product.

It is understood by those skilled in the art, that the present invention could further include a separate automatic interleaver or interweaver for preproportioning the stacks of sliced product with wax paper or plastic film. That is, the automatic interweaver could interweave wax paper, plastic film or the like between each slice or set of slices for obtaining different or separate stacks of sliced product.

To operate the automatic slicing system 10, the comestible product 22 is positioned within the carriage member 26 and secured therein as described above. The operator then turns the switch 62 to the on position to provide power to the automatic slicing system 10. If the system is preliminarily functioning properly, the power light 64 is illuminated. A sheet of plastic wrap or the like (not shown) is then positioned on the receiving surface 50 for receiving the sliced comestible product 22. The operator then programs the microprocessor, using the key pad 60, with the desired weight, price per pound, and how the sliced product should be stacked or any other parameters the operator desires and for which the microprocessor has been programmed. If not microprocessor controlled, the desired thickness of the slices is selected using the knob 40, as is understood by those skilled in the art. The operator then presses the start button (not shown) on the key pad 60 and the automatic slicing system 10 commences operation.

The automatic slicing system 10 then slices and uniformly stacks the comestible product 22 as described above until the desired weight is other selected parameters are met. Upon achieving the desired weight (or other parameters), the automatic slicing system 10 stops and an audible signal is sounded. The operator can then remove the uniform stack of sliced product, package and mark the product with the price computed and printed and present the product to the customer in an efficient and quick manner.

More particularly, the automatic slicing system 10 in accordance with the microprocessor 58 is operated in the following manner, for example. The operator first sets the automatic slicing system lo for operation by positioning the comestible product 22 within the carriage member 26 and selecting a desired product weight and other desired parameters, as described above. Before actuating the slicer blade 18, the microprocessor 58 determines if the door member 32 is open. If the door member 32 is open, the digital display 68 or other indicating means (not shown) informs the operator that the door member 32 is open. The automatic slicing system 10 will not operate until the door member 32 is closed.

Once the door member 32 is closed, the slicer blade 18 is actuated and then the carriage member 26 and receiving surface 50 are actuated. The carriage member 26 begins to move from the start position (far right of FIG. 2) toward the slicer blade 18 at a high rate of speed until the comestible product 22 comes in contact with the slicer blade 18 identifiable because the carriage member 26 slows down upon contact with the comestible product 22. The microprocessor 58 then records the position of the carriage member 26 and defines and stores in memory a first position of the carriage member 26 wherein the comestible product 22 is located adjacent the operational cutting edge of the slicer blade 18 but not in contact therewith.

Once the slicer blade 18 begins to slice the comestible product 22, the microprocessor 58 increases the power to the carriage member 26 in accordance with the difficulty of slicing the comestible product 22. Since it is less difficult to slice cheese as compared to meat (e.g., roast beef), the automatic slicing system 10 only uses the minimum required power to slice the comestible product 22.

For instance, if the carriage member 26 were operated by an electric motor (not shown) the current to the electric motor would be increased proportionally according to the difficulty of slicing the comestible product 22. The amount of current flowing through the electrical motor is used as a feedback signal to the microprocessor 58 which slows down the carriage member 26 according to how difficult it is to push the comestible product 22 into the slicer blade 18 to thereby obtain a consistent slice thickness. This is necessary because hard to slice comestible products have a tendency to be deflected away from the slicer blade 18 when the carriage member 26 is moved too rapidly.

If the comestible product 22 is too hard to slice due to a bone in the product or other slicing problem, the carriage member is returned to the start position and the automatic slicing system is disabled. A slicing problem is then indicated on the display 68. This can be determined because the current to the electric motor driving the carriage member 26 increases above a preset level. Upon sensing the high level of current, the microprocessor 58 returns the carriage member 26 to the start position and indicates a product slicing problem.

Once the carriage member 26 reaches the second position, the sliced comestible product 22 on the receiving surface 50 is weighed. If the desired weight has not been achieved, the carriage member 26 is returned to the first position at a relatively high rate of speed as compared to the slicing speed where the cycle is repeated. As the carriage member 26 oscillates between the first and second positions, the receiving surface 50 moves synchronously therewith, as described above. By returning the carriage member 26 to the first position, instead of the start position, the slicing stroke is reduced or adjusted in accordance with the width of the comestible product 22 to thereby save time. Time is further saved by returning the carriage member 26 to the first position at a high rate of speed.

If, on the other hand, the desired weight of the comestible product 22 has been achieved, the carriage member 26 is returned to the start position, the system is deactivated and an audible signal or the like is actuated to indicate that the slicing operation is completed.

While the automatic slicing system 10 is in the process of slicing the comestible product 22, the operator is free to service customers regarding other needs. Consequently, the automatic slicing system 10 of the present invention decreases operator fatigue and provides a sufficient savings in time as well as money in the operation of the operator's business. Moreover, the automatic slicing system 10 provides hygienic slicing, since there is no human contact as the slices are directly placed onto the plastic wrap.

From the foregoing description, it can be seen that the present invention comprises an automatic slicing system for slicing a comestible product and forming a uniform stack of the sliced product. It is recognized by those skilled in the art, that changes may be made to the above-described embodiment of the invention without departing from the broad inventive concept thereof. It is understood, therefore, that this invention is not limited to be particular embodiment disclosed, but is intended to cover all modifications which are within the spirit and scope of the invention as defined by the appended claims.

I claim:

1. An automatic slicing system for slicing a comestible product and forming a uniform stack of slices of the sliced product, said slicer comprising:

a generally flat movable slicer blade having an operational cutting edge for slicing a comestible product;

a product feed member positioned on one side of said slicer blade for holding and moving said comestible product into engagement with said slicer blade, said product feed member being reciprocally driven to oscillate said comestible product between a first position wherein said comestible product is on one side of said operational cutting edge not in engagement therewith and a second position wherein said comestible product is on another side of said operational cutting edge not in engagement therewith such that as said comestible product moves from said first position to said second position a slice of said comestible product is removed therefrom, said product feed member being driven from said first position to said second position at least twice for slicing at least first and second slices of said comestible product, each slice having a first surface, a second surface and a circumferential edge; and a reciprocating receiving means directly positioned on the other side of said slicer blade and movable between a first and second position and synchronized for movement with said product feed member such that as said product feed member moves between said first and second positions said receiving means moves correspondingly therewith to directly receive each product slice in a uniform stacked manner.

2. The automatic slicing system as recited in claim 1, wherein said reciprocating receiving means receives said sliced comestible product such that the second surface of said first slice is in engagement with said first surface of said second slice and the circumferential edge of said first slice is generally aligned with the circumferential edge of said second slice to thereby form a uniform stack.

3. The automatic slicing system as recited in claim 1, wherein said reciprocating receiving means includes a generally flat receiving surface for receiving each slice of said comestible product, said uniform stack having a top slice of said comestible product, said receiving means further including positioning means for positioning said receiving surface such that the top slice of said uniform stack is maintained at a first predetermined distance from said operational cutting edge and for allowing said uniform stack of sliced product to receive another slice of said comestible product, as said comestible product oscillates between said first and second positions, said positioning means moving said receiving surface away from said operational cutting edge by a second predetermined distance such that said top slice of said uniform stack is maintained at said first predetermined distance from said operational cutting edge.

4. The automatic slicing system as recited in claim 3, wherein said first predetermined distance is defined such that the top slice of said uniform stack partially receives and engages another slice of said comestible product thereon before said another slice is completely removed from said comestible product.

5. The automatic slicing system as recited in claim 3, wherein said second predetermined distance is approximately equal to the thickness of said slice of comestible product.

6. The automatic slicing system as recited in claim 1, wherein said reciprocating receiving means includes weight sensor means for sensing the weight of said sliced comestible product thereon and for transmitting an electrical signal corresponding to said weight and wherein the slicing system further comprises control means for controlling the operation of said product feed member and said receiving means, said control means being responsive to said electrical signal from said weight sensor means for stopping movement of said product feed member when said sliced product reaches a selected weight, whereby said slicing system automatically slices and uniformly stacks said comestible product until said selected weight is attained.

7. The automatic slicing system as recited in claim 6, wherein said selected weight is entered into said control means by an operator.

8. The automatic slicing system as recited in claim 6, wherein said control means comprises a programmed microprocessor.

9. The automatic slicing system as recited in claim 6, wherein the control means is adjustable so that said uniform stack of comestible product is arranged in a shingled manner.

10. The automatic slicing system as recited in claim-6, wherein a distance between the first position and the second position defines a slicing stroke, and said control means adjusts said slicing stroke in response to a width of said comestible product.

11. The automatic slicing system as recited in claim 6, Wherein the control means controls said product feed member as said comestible product moves from said first position to said second position in response to a difficulty of slicing the comestible product to thereby achieve uniform slice thickness.

12. The automatic slicing system as recited in claim 1 wherein said product feed member and said reciprocating receiving means are synchronized such that said reciprocating receiving means moves faster than said product feed member as said product feed member and reciprocating receiving means move from said first position to said second position.

13. The automatic slicing system as recited in claim 1 wherein said product feed member moves from said second position to said first position at a relatively higher rate of speed as compared to said product feed member moving from said first position to said second position.

14. An automatic slicing system for slicing a comestible product and forming a uniform stack of slices of the sliced product, said slicer comprising:

a generally flat movable slicer blade having an operational cutting edge for slicing a comestible product;

a product feed member positioned on one side of said slicer blade for holding and moving said comestible product into engagement with said slicer blade, said product feed member being reciprocally driven to oscillate said comestible product between a first position wherein said comestible product is on one side of said operational cutting edge not in engagement therewith and a second position wherein said comestible product is on another side of said operational cutting edge not in engagement therewith such that as said comestible product moves from said first position to said second position a slice of said comestible product is removed therefrom, said product feed member being driven from said first position to said second position at least twice for slicing at least first and second slices of said comestible product, each slice having a first surface, a second surface and a circumferential edge;

a reciprocating receiving means positioned on the other side of said slicer blade and movable between a first and second position and synchronized for movement with said product feed member such that as said product feed member moves between said first and second positions said receiving means moves correspondingly therewith to receive each product slice in a uniform stacked manner, said receiving means includes a generally flat receiving surface for receiving each slice of said comestible product, said reciprocating receiving means receives said sliced comestible product such that the second surface of said first slice is in engagement with said first surface of said second slice and the circumferential edge of said first slice is generally aligned with the circumferential edge of said second slice to thereby form a uniform stack having a top slice of said comestible product;

said receiving means further including positioning means for positioning said receiving surface such that the top slice of said uniform stack is maintained at a first predetermined distance from said operational cutting edge and for allowing said uniform stack of sliced product to receive another slice of said comestible product, as said comestible product oscillates between said first and second positions, said positioning means moving said receiving surface away from said operational cutting edge by a second predetermined distance such that said top slice of said uniform stack is maintained at said first predetermined distance from said operational cutting edge;

said receiving means further including weight sensor means for sensing the weight of said sliced comestible product thereon and for transmitting an electrical signal corresponding to said weight; and control means for controlling the operation of said product feed member and said receiving means, said control means being responsive to said electrical signal from said weight sensor means for stopping movement of said product feed member when said sliced product reaches a selected weight, whereby said slicing system automatically slices and uniformly stacks said comestible product until said selected weight is attained.

15. The automatic slicing system as recited in claim 14, wherein said predetermined weight is entered into said control means by an operator.

16. The automatic slicing system as recited in claim 14, wherein said control means comprises a programmed microprocessor.

17. The automatic slicing system as recited in claim 14, wherein the control means is adjustable so that said uniform stack of comestible product is arranged in a shingled manner.

18. The automatic slicing system as recited in claim 14, wherein said first predetermined distance is defined such that the top slice of said uniform stack partially receives and engages another slice of said comestible product thereon before said another slice is completely removed from said comestible product.

19. The automatic slicing system as recited in claim 14, wherein said second predetermined distance is approximately equal to the thickness of said slice of comestible product.

* * * * *